US011168537B2

(12) United States Patent
Hrupp et al.

(10) Patent No.: US 11,168,537 B2
(45) Date of Patent: Nov. 9, 2021

(54) FLUID-PRESSURE-SET UPHOLE END FOR A HYBRID STRADDLE PACKER

(71) Applicant: Exacta-Frac Energy Services, Inc., Conroe, TX (US)

(72) Inventors: Joze John Hrupp, Montgomery, TX (US); Ahmed Mohamed Saeed, Cypress, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 19 days.

(21) Appl. No.: 16/840,710

(22) Filed: Apr. 6, 2020

(65) Prior Publication Data

US 2021/0310329 A1 Oct. 7, 2021

(51) Int. Cl.

| | |
|---|---|
| ***E21B 33/128*** | (2006.01) |
| ***E21B 43/267*** | (2006.01) |
| ***E21B 34/14*** | (2006.01) |
| ***E21B 43/26*** | (2006.01) |

(52) U.S. Cl.

CPC ..... *E21B 33/1285* (2013.01); *E21B 34/14* (2013.01); *E21B 43/2607* (2020.05); *E21B 43/267* (2013.01); *E21B 2200/04* (2020.05)

(58) Field of Classification Search

CPC .... E21B 33/128; E21B 33/1285; E21B 33/10; E21B 33/12

See application file for complete search history.

(56) References Cited

U.S. PATENT DOCUMENTS

| | | | | |
|---|---|---|---|---|
| 2,715,444 | A * | 8/1955 | Fewel | E21B 33/124 166/147 |
| 4,567,944 | A | 2/1986 | Zunkel et al. | |
| 4,589,485 | A * | 5/1986 | Wray | E21B 33/124 166/142 |
| 4,590,995 | A | 5/1986 | Evans | |
| 4,962,815 | A | 10/1990 | Schultz et al. | |
| 5,291,947 | A | 3/1994 | Stracke | |
| 6,253,856 | B1 | 7/2001 | Ingram et al. | |
| 6,655,461 | B2 | 12/2003 | Eslinger et al. | |
| 6,695,057 | B2 * | 2/2004 | Ingram | E21B 43/26 166/308.1 |
| 6,883,610 | B2 | 4/2005 | Depiak | |
| 9,267,348 | B2 * | 2/2016 | Ingram | E21B 23/06 |
| 9,291,044 | B2 | 3/2016 | Murphy et al. | |
| 9,598,939 | B2 | 3/2017 | Lee | |
| 2007/0235194 | A1 | 10/2007 | Maier | |
| 2015/0376979 | A1 | 12/2015 | Mitchell et al. | |
| 2016/0376868 | A1 | 12/2016 | Manke | |

* cited by examiner

*Primary Examiner* — Kenneth L Thompson

(74) *Attorney, Agent, or Firm* — J. Bennett Mullinax, LLC

(57) ABSTRACT

A fluid-pressure-set uphole end for a hybrid straddle packer has a multicomponent mandrel with a fixed piston and a multicomponent sliding sleeve with a sliding sleeve piston housing that houses the fixed piston. The multicomponent sliding sleeve reciprocates within a limited range on the multicomponent mandrel in response to fluid pressure pumped into a central passage of the multicomponent mandrel. An anti-set spring constantly resists relative movement between the multicomponent mandrel and the multicomponent sliding sleeve and returns the uphole end to a run-in condition when fluid pressure in the central passage is released.

20 Claims, 4 Drawing Sheets

FLUID-PRESSURE-SET UPHOLE END FOR A HYBRID STRADDLE PACKER

CROSS REFERENCE TO RELATED APPLICATIONS

This is the first application filed for this invention.

FIELD OF THE INVENTION

This invention relates in general to precision fracking systems and, in particular, to a fluid-pressure-set uphole end for a hybrid straddle packer for cased or open hole well stimulation or remediation.

BACKGROUND OF THE INVENTION

Well bore pressure isolation tools, commonly referred to as "straddle packers", are known and used to pressure isolate a downhole area of interest in a cased or open hydrocarbon well bore for the purpose of what is known as focused or precision well stimulation or remediation. Straddle packers designed for this purpose are well known, but their use has been associated with operational issues that frequently render them unreliable. Consequently, Applicant Invented an uphole end for compression-set straddle packers that is described in Applicant's co-pending U.S. patent application Ser. No. 16/289,805 filled Mar. 1, 2019. Compression-set straddle packers are especially useful when pumping stimulation fluids containing up to about 4 pounds or less of proppant per gallon of pumped fluid. However, when pumping stimulation fluids that contain more than about 4 pounds per gallon of proppant, compression-set straddle packers may not operate optimally under all conditions.

Heavily proppant-laden fluids have been pumped using packer cups uphole from a compression-set packer to straddle and isolate perforations in a well bore. This arrangement permits "reverse" circulation (pumping proppant-free fluid down an annulus of the well) in the event of a "screen-out" (work string blockage due to proppant accumulation in the work string and/or the straddle packer), without moving pipe in the hole. However, packer cups have many operational disadvantages because cup-drag and cup-wear limit their use to shallow wells and a small number of zones per trip in the hole, as is well understood by those skilled in the art.

There therefore exists a need for a hybrid straddle packer that enables forward or reverse fluid circulation without pipe movement if a screen-out occurs while pumping proppant-laden stimulation fluids.

SUMMARY OF THE INVENTION

It Is therefore an object of the invention to provide a fluid-pressure-set uphole end for a hybrid straddle packer.

The invention therefore provides an uphole end for a fluid-pressure-set straddle packer, comprising: a multicomponent mandrel having a work string connection component upper end that supports a packer element, and a mandrel packer connection component lower end, with a mandrel flow sub, a mandrel spring support component and a mandrel fixed piston component having a fixed piston between the upper end and the lower end, the multicomponent mandrel having an upper mandrel central passage that extends through the multicomponent mandrel from the upper end to a lower end of the mandrel flow sub, a mid-mandrel central passage that extends through the multicomponent mandrel from the lower end of the mandrel flow sub to the fixed piston, a lower mandrel central passage that extends through the multicomponent mandrel from the fixed piston through the mandrel packer connection component, and a flow preventor that blocks fluid flow from the mid-mandrel central passage to the lower mandrel central passage; a multicomponent sliding sleeve that surrounds the multicomponent mandrel between the packer element and the mandrel packer connection component and reciprocates on the multicomponent mandrel from a run-in to a packer-set condition, a sliding sleeve spring housing that houses an ant-set spring supported on the mandrel spring support component, and a sliding sleeve piston housing that provides a piston chamber which houses the fixed piston.

The Invention further provides an uphole end for a fluid-pressure-set straddle packer, comprising: a multicomponent mandrel having a work string connection component upper end with a packer element sleeve that supports a packer element, and a mandrel packer connection component lower end, the multicomponent mandrel further having a mandrel flow sub, a mandrel spring support component and a mandrel fixed piston component with a fixed piston respectively located between the upper end and the lower end, the multicomponent mandrel having an upper mandrel central passage that extends through the multicomponent mandrel from the upper end to a proppant exclusion filter in the mandrel flow sub, a mid-mandrel central passage that extends through the multicomponent mandrel from the proppant exclusion filter to the fixed piston, a lower mandrel central passage that extends through the multicomponent mandrel from the fixed piston through the mandrel packer connection component, and a flow preventor that blocks fluid flow from the mid-mandrel central passage to the lower mandrel central passage; a multicomponent sliding sleeve that surrounds the multicomponent mandrel between the packer element and the mandrel packer connection component and reciprocates on the multicomponent mandrel from a run-in condition in which a packer element of the uphole end is in an unset condition to a packer-set condition, a sliding sleeve spring housing that houses an ant-set spring supported on the mandrel spring support component, a sliding sleeve piston housing with a piston chamber that houses the fixed piston, and a sliding sleeve termination seal that provides a fluid seal on between the multicomponent sliding sleeve and the multicomponent mandrel on a backside of the fixed piston.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
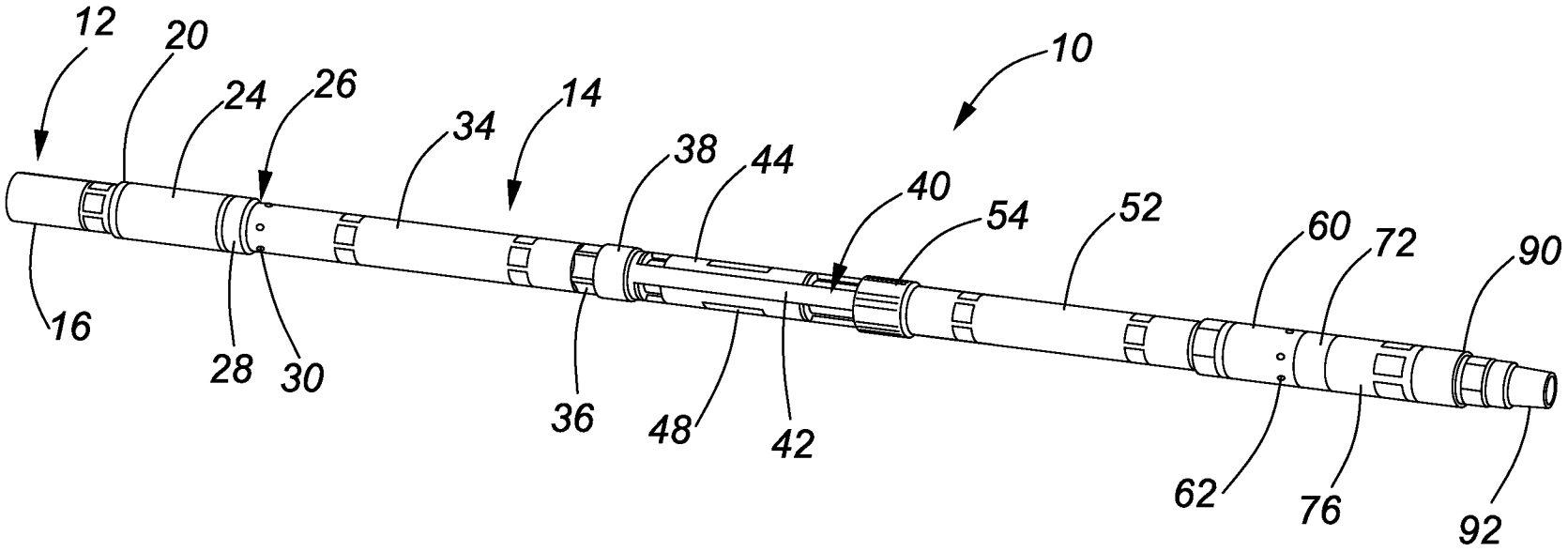
FIG. 1 is a perspective view of an embodiment of a fluid-pressure-set uphole end for a hybrid straddle packer in accordance with the invention.

The Invention provides a fluid-pressure-set uphole end for a hybrid straddle packer. In this embodiment, "hybrid straddle packer" means a straddle packer with a fluid-pressure-set uphole end connected to a compression-set packer. The fluid-pressure-set uphole end may be connected to substantially any compression-set packer to provide a hybrid straddle packer that may be used in precision well stimulation or remediation treatments in either open hole or cased well bores (hereinafter referred to collectively as "well bores"). A length of a zone in a well bore that is pressure isolated by the hybrid straddle packer may be adjusted, if desired, by inserting tubular extensions between the fluid-pressure-set uphole end and the compression-set packer.

The fluid-pressure-set uphole end has a multicomponent mandrel that extends from an upper end to a lower end thereof. The upper end of the multicomponent mandrel is a work string connection component and the lower end is a connector component for extension tubes and/or the compression-set packer. A multicomponent sliding sleeve surrounds the multicomponent mandrel between the work string connection component and the connector component. The multicomponent sliding sleeve reciprocates within a limited range over the multicomponent mandrel in response to fluid pressure pumped through a work string connected to the work string connection component. The multicomponent mandrel includes a mandrel flow sub component that has at least one flow sub slot used to inject well stimulation or well remediation fluid (hereinafter referred to collectively as "high-pressure fluid") into a section of a well bore that is pressure isolated by the hybrid straddle packer. In this document, "flow sub slot" means any orifice, permanent or interchangeable, through which high-pressure fluid may be pumped, including but not limited to a nozzle, a bore and a slot.

When high-pressure fluid is pumped into the fluid-pressure-set uphole end, fluid is forced through piston ports in the multicomponent mandrel. The pressurized fluid accumulates in a piston chamber behind a fixed piston on the multicomponent mandrel, generating a linear force on the multicomponent sliding sleeve that overcomes the resistance of an anti-set spring and slides the multicomponent sliding sleeve over the multicomponent mandrel to set the packer on the fluid-pressure-set uphole end. High-pressure fluid may then be pumped through the work string into the pressure isolated section of the well bore. When the high-pressure fluid treatment is completed or stopped, the anti-set spring unsets the fluid-pressure-set packer. This permits forward or reverse fluid circulation without pipe movement in the event of a screen-out during well stimulation.

| Part No. | Part Description |
|---|---|
| 10 | Fluid pressure set uphole end for a hybrid straddle packer |
| 12 | Multicomponent mandrel |
| 14 | Multicomponent sliding sleeve |
| 16 | Work string connection component |
| 18 | Work string connection |
| 20 | Packer element compression shoulder |
| 22 | Packer element sleeve |
| 24 | Packer element |
| 26 | Compression bell |
| 28 | Compression bell compression shoulder |
| 30 | Compression bell pressure equalization ports |
| 32 | Upper mandrel tube |
| 34 | Upper sliding sleeve |
| 36 | Upper sliding sleeve union |
| 38 | Slotted sliding sleeve female coupling end |
| 40 | Slotted sliding sleeve |
| 42 | Sliding sleeve finger components |
| 44 | Mandrel flow sub |
| 48 | Mandrel flow sub slots |

-continued

| Part No. | Part Description |
|---|---|
| 50 | Lower sliding sleeve union |
| 52 | Lower sliding sleeve |
| 54 | Slotted sliding sleeve captured end coupling ring |
| 56 | Cap screws |
| 58 | Lower mandrel tube |
| 60 | Sliding sleeve spring housing |
| 62 | Spring housing pressure equalization ports |
| 64 | Mandrel spring support component |
| 66 | Anti-set spring stop ring |
| 68 | Anti-set spring |
| 70 | Anti-set spring push ring |
| 72 | Sliding sleeve crossover |
| 74 | Mandrel fixed piston component |
| 75 | Fixed piston |
| 76 | Sliding sleeve piston housing |
| 77 | Piston chamber |
| 78 | Mandrel piston ports |
| 80 | Mandrel piston seal |
| 82 | Mandrel pressure equalization ports |
| 84 | Captured ball |
| 86 | Captured ball seat |
| 88 | Sliding sleeve termination seal |
| 90 | Mandrel packer connection component |
| 92 | Connection component end thread |
| 94 | Upper mandrel central passage |
| 96 | Proppant exclusion filter |
| 98 | Mid-mandrel central passage |
| 99 | Flow preventor |
| 100 | Lower mandrel central passage |
| 102 | Mandrel blanked-off piston component |
| 104 | Blanked-off piston |

FIG. 1 is a perspective view of one embodiment of the fluid-pressure-set uphole end 10 for a hybrid straddle packer (hereinafter simply "uphole end 10") in accordance with one embodiment of the invention. The uphole end 10 has a multicomponent mandrel 12, the majority of which can only be seen in a cross-sectional view (see FIGS. 2-4). The multicomponent mandrel 12 extends completely through the uphole end 10 and is surrounded by a multicomponent sliding sleeve 14, which reciprocates within a limited range over the multicomponent mandrel 12. The multicomponent mandrel 12 includes a work string connection component 16 with a work string connection 18 (see FIG. 2). A configuration of the work string connection 18 is a matter of design choice and dependent on whether the uphole end 10 is to be operated using a coil tubing string (not shown) or jointed tubing string (not shown), as is well understood in the art.

The work string connection component 16 has a packer element compression shoulder 20 and a packer element sleeve 22 (see FIG. 2) that supports an elastomeric packer element 24, the function of which is well understood in the art. A compression bel 26, having compression bell shoulder 28 and pressure equalization ports 30, is a component of the multicomponent sliding sleeve 14 and is connected to an upper sliding sleeve 34. The upper sliding sleeve 34 is connected to an upper sliding sleeve union 36, which is in turn connected to a female coupling end 38 (see FIG. 2) of a slotted sliding sleeve 40. In one embodiment, the slotted sliding sleeve 40 has three slotted sliding sleeve finger components 42 that are respectively received in grooves in a mandrel flow sub 44, the function of which will be explained below. The slotted sliding sleeve finger components 42 define three elongated openings that respectively expose a mandrel flow sub slot 48 of the mandrel flow sub 44. In this embodiment, the mandrel flow sub 44 has three mandrel flow sub slots 48. It should be understood the number of mandrel flow sub slots is a matter of design choice. A downhole end of the slotted sliding sleeve finger components 42 are threadedly connected to a slotted sliding sleeve captured end coupling ring 54 that surrounds a lower sliding sleeve union 50 (see FIG. 2), which is threadedly connected to a lower sliding sleeve 52. A downhole end of the lower sliding sleeve 52 is connected to a sliding sleeve spring housing 60 having spring housing equalization ports 62. A sliding sleeve crossover 72 is connected to a lower end of the siding sleeve sliding sleeve spring housing 60. A lower end of the sliding sleeve crossover 72 is connected to an upper end of a sliding sleeve piston housing 76, which is a last component of the multi-component sliding sleeve 14. A downhole end of the sliding sleeve piston housing 76 is sealed by a sliding sleeve termination seal 88, which provides a fluid-tight seal between the multicomponent sliding sleeve 14 and the multicomponent mandrel 12 on a backside of the fixed piston 75. The multicomponent mandrel 12 is terminated by a mandrel packer connection component 90, which is used to connect a compression-set packer (not shown) to the uphole end 10 to provide a hybrid straddle packer. The compression-set packer may be connected directly to mandrel connection component end thread 92 of the mandrel packer connection component 90, or one or more extension pipes (not shown) can be connected to the mandrel connection component end thread 92, in which case the compression-set packer is connected to a lower end of the extension pipe(s) to increase a length of a well bore that is pressure isolated by the hybrid straddle packer.

Figure 2:
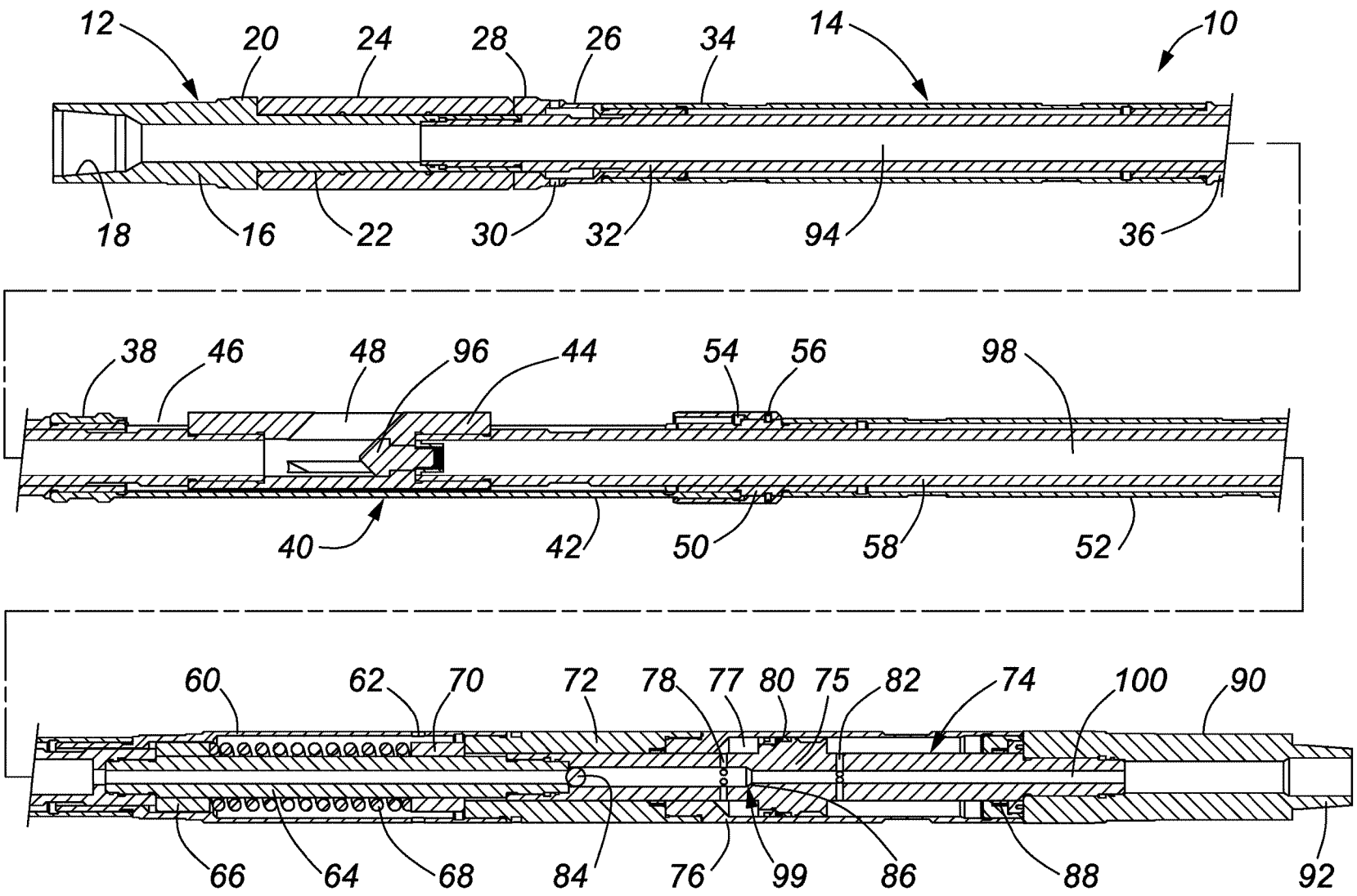
FIG. 2 is a cross-sectional view of the fluid-pressure-set uphole end for a hybrid straddle packer shown in FIG. 1.

FIG. 2 is a cross-sectional view of the uphole end 10 shown in FIG. 1, in a run-in condition in which the uphole end 10 is inserted into a well bore and moved to a selected location within the well bore. As explained above, the elastomeric packer element 24 is supported on the packer element sleeve 22 of the work string connection component 16. As further explained above, the slotted sliding sleeve 40 is connected to the lower sliding sleeve 52 by the lower sliding sleeve union 50, which is threadedly connected to both the slotted sliding sleeve 40 and the lower sliding sleeve 52. The slotted sliding sleeve captured end coupling ring 54 that covers the lower sliding sleeve union 50 is likewise threadedly connected to free ends of the slotted sliding sleeve finger components 42. Rotation of the slotted sliding sleeve captured end coupling ring 541*s* inhibited by cap screws 56. The multicomponent mandrel 12 has an upper mandrel central passage 94 that provides an uninterrupted fluid path through the multicomponent mandrel 12 to a proppant exclusion filter 96. The proppant exclusion filter 96 excludes all proppant from well stimulation fluid pumped into the upper mandrel central passage 94 but permits fluid components of the well stimulation fluid to flow into a mid-mandrel central passage 98 of the multicomponent mandrel 12. The proppant exclusion filter 96 is explained in detail in Applicant's co-pending U.S. patent application Ser. No. 16/456,021 filed Jun. 28, 2019 entitled Straddle Packer With Fluid Pressure Packer Set and Velocity Bypass for Proppant-Laden Fracturing Fluids, the specification of which is incorporated herein by reference. A flow preventor 99 inhibits any downhole fluid communication between the mid-mandrel central passage 98 and a lower mandrel central passage 100. In one embodiment, the flow preventor 99 is a captured ball 84 that seats on a captured ball seat 86 in a fluid-tight seal. In another embodiment described below with reference to FIG. 4, the flow preventor is a blanked-off piston. The multicomponent mandrel 12 includes the following threadedly interconnected components: the work string connection component 16, which is connected to an upper mandrel tube 32; the mandrel flow sub 44 is connected to a lower end of the upper mandrel tube 32; a lower mandrel tube 58 is connected to a downhole end of the mandrel flow sub 44; a mandrel spring support component 64 is connected to a lower end of the lower mandrel tube 58; a mandrel fixed piston component 74 is connected to a lower end of the mandrel spring support component 64; and, the mandrel packer connection component 90 having the connection component end thread 92 is connected to the mandrel fixed piston component 74.

The mandrel spring support component 64 supports an anti-set spring stop ring 66 that abuts a downhole end of the lower mandrel tube 58, an anti-set spring 68 and an anti-set spring push ring 70 that abuts an uphole end of the sliding sleeve crossover 72. The anti-set spring 68 is a coil compression spring that constantly urges the multicomponent sliding sleeve 14 to an unset condition in which a downhole end of the sliding sleeve piston housing abuts an uphole end of the mandrel packer connection component 90 and the packer element 24 is in an unset condition. In one embodiment, the anti-set spring 68 is pre-loaded with about 200 pounds of compressive force The mandrel fixed-piston component 74 has a fixed piston 75 with a mandrel piston seal 80. The fixed piston 75 is received in a piston chamber 77 of the sliding sleeve piston housing 76. The piston seal inhibits any fluid migration between a frontside and a backside of the fixed piston 75. Mandrel piston ports 78 provide fluid communication between the mid-mandrel central passage 98 and the piston chamber 77, on the frontside of the fixed piston 75. Mandrel pressure equalization ports 82 provide fluid communication between the lower mandrel central passage 100 and the piston chamber 77, on the backside of the fixed piston 75. When well stimulation fluid is pumped into the upper mandrel central passage 94, fluid components of the well stimulation fluid pass through the proppant exclusion filter 96 and enter the mid-mandrel central passage 98. High-pressure fluid entering the mid-mandrel central passage-94*j*0 forces the captured ball 84 against the captured ball seat 86 and flows through the mandrel piston ports 78 into the piston chamber 77 on the frontside of the fixed piston 75 forcing uphole movement of the multicomponent sliding sleeve 14, as will be explained below in more detail with reference to FIG. 3.

Figure 3:
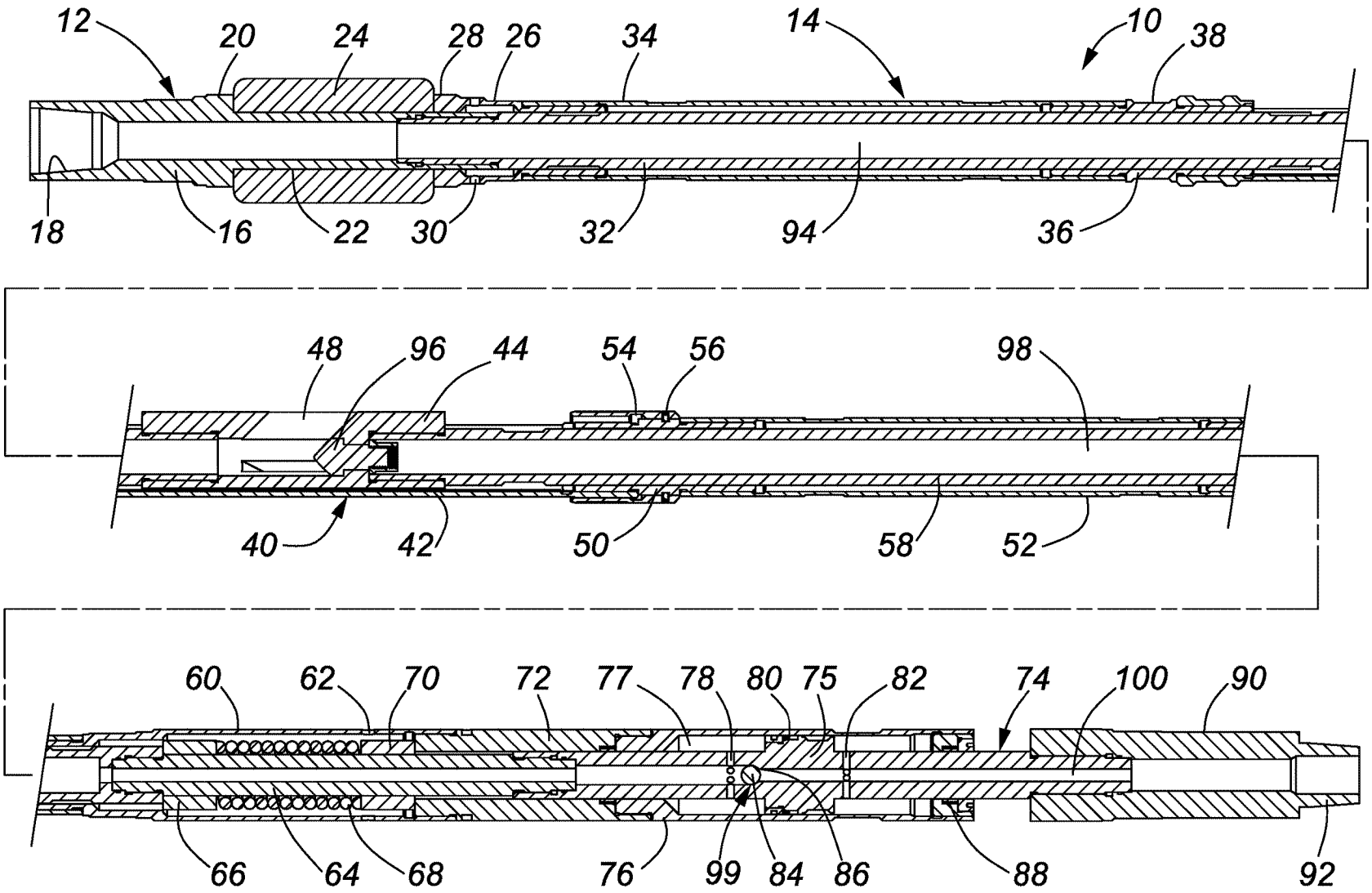
FIG. 3 is a cross-sectional view of the fluid-pressure-set uphole end shown in FIG. 2, in a packer-set condition.

FIG. 3 is a cross-sectional view of the uphole end 10 showing the end 10 in a packer-set condition. In the packer set condition the anti-set spring 68 is compressed by the multicomponent sliding sleeve 14. As explained above, when well stimulation fluid is pumped into the upper mandrel central passage 94 fluid components of the well stimulation fluid pass through the proppant exclusion filter 96 and enter the mid-mandrel central passage 98. High pressure fluid entering the mid-mandrel central passage 98 forces the captured ball 84 against the captured ball seat 86 and flows through the mandrel piston ports 78 into the piston chamber 77. Since the fixed piston 75 is integral with the multicomponent mandrel 12, the high-pressure fluid expands the piston chamber 77 by forcing the sliding sleeve piston housing 76 uphole against the resistance of the anti-set spring 68 and the packer element 24. As the fluid pressure builds, the anti-set spring 68 and the packer element 24 compress until the anti-set spring is at full compression, at with point the packer element is fully packed-off and provided a fluid tight seal with the well bore. Once the packer element 24 is fully packed-off, all high-pressure fluid pumped into the upper mandrel passage 94 passes through the mandrel flow sub slots 48 and into a pressure-isolated section of the well bore. When stimulation of the isolated section is completed and pumping stops, the reduction in fluid pressure in the upper mandrel passage 94 lets clear fluid flow back through the proppant exclusion filter 96, and the anti-set spring 68 returns the multi-component sliding sleeve 14 to the unset condition shown in FIG. 3. The same thing occurs if a "screen-out" occurs while pumping proppant-laden fluid. Once the packer element 24 is unset, the well bore may be forward and/or reverse circulated to clear the proppant blockage, without necessitating pipe movement. This is particularly beneficial when the work string connected to the uphole end 10 is hung from a tubing hanger while an isolated section of the well bore is being stimulated, to permit stimulation fluid to be pumped through an isolated well head or a frac head, as understood by those skilled in the art.

Figure 4:
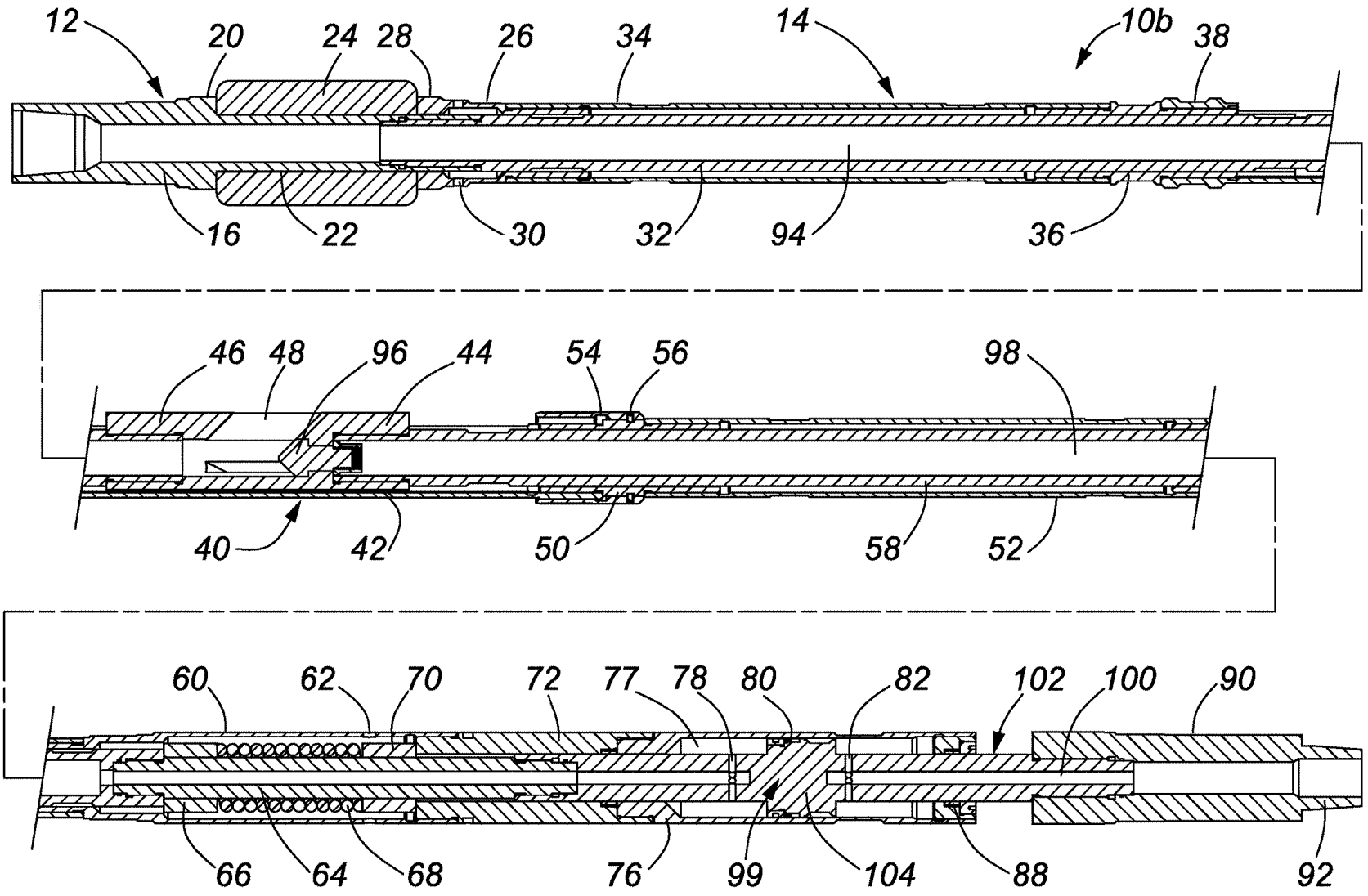
FIG. 4 is a cross-sectional view of another embodiment of the fluid-pressure-set uphole end for a hybrid straddle packer in accordance with the invention.

FIG. 4 is a cross-sectional view of another embodiment of an end 10*b* for a hybrid straddle packer in accordance with the invention. Each of the components and features of the fluid-pressure-set uphole end 10*b* have been described above with reference to FIGS. 1-3 except the flow preventor 99 that inhibits any downhole fluid communication between the mid-mandrel central passage 98 and the lower mandrel central passage 100. In this embodiment, the flow preventor 99 is a blanked-off piston 104 of a blanked-off piston component 102 in the multicomponent mandrel 12. The blanked-off piston 104 does not permit any fluid communication between the mid-mandrel central passage 98 and the lower mandrel central passage 100, or vice versa. Whereas the captured ball 84 (see FIGS. 2 and 3) prevents downhole fluid communication but permits a limited fluid flow from the mid-central passage 98 to the upper central passage 94 during forward and reverse fluid circulation because no uphole ball seat for the captured ball 84 is provided. The uphole end 10*b* is operated in the same way described above with reference to the uphole end 10 described above.

The explicit embodiments of the invention described above have been presented by way of example only. The scope of the invention is therefore intended to be limited solely by the scope of the appended claims.

We claim:

1. An uphole end for a fluid-pressure-set straddle packer, comprising:

a multicomponent mandrel having a work string connection component upper end that supports a packer element, and a mandrel packer connection component lower end, with a mandrel flow sub, a mandrel spring support component and a mandrel fixed piston component having a fixed piston between the upper end and the lower end, the multicomponent mandrel having an upper mandrel central passage that extends through the multicomponent mandrel from the upper end to a lower end of the mandrel flow sub, a mid-mandrel central passage that extends through the multicomponent mandrel from the lower end of the mandrel flow sub to the fixed piston, a lower mandrel central passage that extends through the multicomponent mandrel from the fixed piston through the mandrel packer connection component, and a flow preventor that blocks fluid flow from the mid-mandrel central passage to the lower mandrel central passage;

a multicomponent sliding sleeve that surrounds the multicomponent mandrel between the packer element and the mandrel packer connection component and reciprocates on the multicomponent mandrel from a run-in to a packer-set condition, a sliding sleeve spring housing that houses an anti-set spring supported on the mandrel spring support component, and a sliding sleeve piston housing that provides a piston chamber which houses the fixed piston.

2. The uphole end as claimed in claim 1 wherein the multicomponent mandrel further comprises: an upper mandrel tube connected to a downhole end of the work string connection component; the mandrel flow sub connected to a downhole end of the upper mandrel tube, the mandrel flow sub having at least one mandrel flow sub slot in fluid communication with the upper mandrel central passage; a lower mandrel tube connected to a downhole end of the mandrel flow sub; the mandrel spring support component connected to a downhole end of the lower mandrel tube; and the mandrel fixed piston component connected to a downhole end of the mandrel spring support component.

3. The uphole end as claimed in claim 2 wherein the multicomponent sliding sleeve further comprises: an upper sliding sleeve connected to a compression bell that slides over a downhole end of a packer element sleeve of the work string connection component, the upper sliding sleeve sliding over the upper mandrel tube; a slotted sliding sleeve connected to a downhole end of the upper sliding sleeve, the slotted sliding sleeve sliding over the mandrel flow sub and having slotted sliding sleeve finger components that define slots that expose the at least one mandrel flow sub slot; a lower sliding sleeve connected to a downhole end of the slotted sliding sleeve, the sliding sleeve spring housing connected to a downhole end of the lower sliding sleeve; a sliding sleeve crossover connected to a downhole end of the sliding sleeve spring housing; and the sliding sleeve piston housing connected to a downhole end of the sliding sleeve crossover.

4. The uphole end as claimed in claim 1 wherein the flow preventor comprises a captured ball in a downhole end of the mid-mandrel central passage and a captured ball seat in the mandrel fixed piston component.

5. The uphole end as claimed in claim 1 wherein the flow preventor is a blanked-off piston of the mandrel fixed piston component.

6. The uphole end as claimed in claim 2 wherein the mandrel spring support component supports an anti-set compression spring between an anti-set stop ring that abuts a downhole end of the lower mandrel tube and an anti-set push ring that abuts an uphole end of a sliding sleeve crossover.

7. The uphole end as claimed in claim 1 wherein the upper mandrel central passage is separated from the mid-mandrel central passage by a proppant exclusion filter.

8. The uphole end as claimed in claim 1 wherein the mandrel fixed piston component comprises mandrel piston ports that provide fluid communication between the mid-mandrel central passage and a frontside of the piston chamber, and mandrel pressure equalization ports that provide fluid communication between the piston chamber on a backside of the fixed piston and the lower mandrel central passage.

9. The uphole end as claimed in claim 1 wherein the multicomponent sliding sleeve further comprises a sliding sleeve termination seal that provides a fluid seal between the multicomponent sliding sleeve and the multicomponent mandrel on a backside of the fixed piston.

10. The uphole end as claimed in claim 1 wherein the sliding sleeve spring housing comprises spring housing pressure equalization ports.

11. An uphole end for a fluid-pressure-set straddle packer, comprising:

a multicomponent mandrel having a work string connection component upper end with a packer element sleeve that supports a packer element, and a mandrel packer connection component lower end, the multicomponent mandrel further having a mandrel flow sub, a mandrel spring support component and a mandrel fixed piston component with a fixed piston respectively located between the upper end and the lower end, the multicomponent mandrel having an upper mandrel central passage that extends through the multicomponent mandrel from the upper end to a proppant exclusion filter in the mandrel flow sub, a mid-mandrel central passage that extends through the multicomponent mandrel from the proppant exclusion filter to the fixed piston, a lower mandrel central passage that extends through the multicomponent mandrel from the fixed piston through the mandrel packer connection component, and a flow preventor that blocks fluid flow from the mid-mandrel central passage to the lower mandrel central passage;

a multicomponent sliding sleeve that surrounds the multicomponent mandrel between the packer element and the mandrel packer connection component and reciprocates on the multicomponent mandrel from a run-in condition in which a packer element of the uphole end is in an unset condition to a packer-set condition, a sliding sleeve spring housing that houses an anti-set spring supported on the mandrel spring support component, a sliding sleeve piston housing with a piston chamber that houses the fixed piston, and a sliding sleeve termination seal that provides a fluid seal on between the multicomponent sliding sleeve and the multicomponent mandrel on a backside of the fixed piston.

12. The uphole end as claimed in claim 11 wherein the multicomponent mandrel further comprises: an upper mandrel tube connected to a downhole end of the work string connection component the mandrel flow sub connected to a downhole end of the upper mandrel tube, the mandrel flow sub having at least one mandrel flow sub slot in fluid communication with the upper mandrel central passage; a lower mandrel tube connected to a downhole end of the mandrel flow sub; the mandrel spring support component connected to a downhole end of the lower mandrel tube; and the mandrel fixed piston component connected to a downhole end of the mandrel spring support component.

13. The uphole end as claimed in claim 12 wherein the multicomponent sliding sleeve further comprises: an upper sliding sleeve connected to a compression bell that slides over a downhole end of the packer element sleeve of the work string connection component, the upper sliding sleeve sliding over the upper mandrel tube; a slotted sliding sleeve connected to a downhole end of the upper sliding sleeve, the slotted sliding sleeve sliding over the mandrel flow sub and having slotted sliding sleeve finger components that define slots that expose the at least one mandrel flow sub slot; a lower sliding sleeve connected to a downhole end of the slotted sliding sleeve, the sliding sleeve spring housing connected to a downhole end of the lower sliding sleeve; a sliding sleeve crossover connected to a downhole end of the sliding sleeve spring housing; and the sliding sleeve piston housing connected to a downhole end of the sliding sleeve crossover.

14. The uphole end as claimed in claim 11 wherein the flow preventor comprises a captured ball in a downhole end of the mid-mandrel central passage and a captured ball seat in the mandrel fixed piston component.

15. The uphole end as claimed in claim 11 wherein the flow preventor is a blanked-off piston of the mandrel fixed piston component.

16. The uphole end as claimed in claim 13 wherein the mandrel spring support component supports an anti-set compression spring between an anti-set stop ring that abuts a downhole end of the lower mandrel tube and an anti-set push ring that abuts an uphole end of the sliding sleeve crossover.

17. The uphole end as claimed in claim 11 wherein the mandrel fixed piston component comprises mandrel piston ports that provide fluid communication between the mid-mandrel central passage and a frontside of the piston chamber, and mandrel pressure equalization ports that provide fluid communication between the piston chamber on a backside of the fixed piston and the lower mandrel central passage.

18. The uphole end as claimed in claim 11 wherein the sliding sleeve spring housing comprises spring housing pressure equalization ports.

19. An uphole end for a fluid-pressure-set straddle packer, comprising:

a multicomponent mandrel having a work string connection component with a packer element sleeve that supports a packer element, an upper mandrel tube connected to the packer element sleeve, a mandrel flow sub having at least one mandrel flow sub slot for injecting high-pressure fluid into a well bore, a lower mandrel tube connected to the mandrel flow sub, a mandrel spring support component connected to the lower mandrel tube, and a mandrel fixed piston component with a fixed piston and radial fluid ports on a frontside and a backside of the fixed piston, the mandrel fixed piston component being connected to the mandrel spring support component, and a mandrel packer connection component connected to the mandrel fixed piston component, the multicomponent mandrel having an upper mandrel central passage that extends through the multicomponent mandrel from an uphole end of the work string connection component to a proppant exclusion filter in the mandrel flow sub downhole of the at least one mandrel flow sub slot, a mid-mandrel central passage that extends through the multicomponent mandrel from the proppant exclusion filter to the fixed piston, a lower mandrel central passage that extends through the multicomponent mandrel from the fixed piston through the mandrel packer connection component, a flow preventor that blocks fluid flow from the mid-mandrel central passage to the lower mandrel central passage;

a multicomponent sliding sleeve that surrounds the multicomponent mandrel between the packer element and the mandrel packer connection component and reciprocates on the multicomponent mandrel from a run-in condition in which a packer element of the uphole end is in an unset condition to a packer-set condition in which the packer element is expanded to a set condition, the sliding sleeve comprising a compression bell, an upper sliding sleeve connected to the compression bell, a slotted sliding sleeve that surrounds the mandrel flow sub and is connected to the upper sliding sleeve, a lower sliding sleeve connected to the slotted sliding sleeve, a sliding sleeve spring housing that houses an anti-set spring supported on the mandrel spring support component connected to the lower sliding sleeve, a sliding sleeve crossover connected to the sliding sleeve spring housing, a sliding sleeve piston housing with a piston chamber that houses the fixed piston connected to the sliding sleeve crossover, and a sliding sleeve termination seal that provides a fluid seal on between the multicomponent sliding sleeve and the multicomponent mandrel on a backside of the fixed piston.

20. The uphole end as claimed in claim 19 wherein the flow preventor comprises one of a captured ball in a downhole end of the mid-mandrel central passage and a captured ball seat in the mandrel fixed piston component, and a blanked-off piston of the mandrel fixed piston component.

* * * * *